US005509281A

United States Patent [19]

Tsay

[11] Patent Number: 5,509,281

[45] Date of Patent: Apr. 23, 1996

[54] DUST BLOWER FOR CIRCULAR KNITTING MACHINES

[76] Inventor: Jiann-Ting Tsay, No. 3, Alley 6, Lane 27, Chung-Hsing Rd., Hsi-Chih Chen, Taipei Hsien, Taiwan

[21] Appl. No.: 392,479

[22] Filed: Feb. 22, 1995

[51] Int. Cl.[6] ..... D04B 35/32

[52] U.S. Cl. ..... 66/168; 15/301; 15/318

[58] Field of Search ..... 66/168; 15/301, 15/318

[56] References Cited

U.S. PATENT DOCUMENTS

| | | | |
|---|---|---|---|
| 2,325,023 | 7/1943 | Allred | 66/168 X |
| 3,678,713 | 7/1972 | Woodford | 66/168 X |
| 4,691,536 | 9/1987 | Yorisue et al. | 66/168 |
| 4,903,367 | 2/1990 | Brunner | 15/301 |
| 5,175,905 | 1/1993 | Gutschmit | 66/168 X |
| 5,417,090 | 1/1995 | Baumann | 66/168 |

FOREIGN PATENT DOCUMENTS

| | | | |
|---|---|---|---|
| 1657553 | 6/1991 | U.S.S.R. | 66/168 |

*Primary Examiner*—John J. Calvert
*Attorney, Agent, or Firm*—Bacon & Thomas

[57] ABSTRACT

A dust blower mounted at the center of a circular knitting machine for blowing dust and fluff away from the annular loop-forming zone of the circular knitting machine, and including a rigid guide tube connected to a compressed air source and rotated horizontally by a constant speed motor, and a swivel nozzle head mounted on one end of the rigid guide tube and rotated vertically when compressed air is driven out of its radial nozzles.

2 Claims, 3 Drawing Sheets

DUST BLOWER FOR CIRCULAR KNITTING MACHINES

BACKGROUND OF THE INVENTION

The present invent ion relates to a structure of a dust blower for removing dust from a circular knitting machine during the knitting operation of the machine.

Various knitting machines have been developed for knitting a variety of fabrics. During the knitting operation of a knitting machine, more particularly a circular knitting machine, dust and fluff must be removed from the machine so that the machine can keep operating smoothly. There are two known ways to remove dust and fluff from a circular knitting machine. One way is to use a dust collecting system to collect dust and fluff from the annular loop-forming zone of the circular knitting machine. For example, DUST-COLLECTING SYSTEM of German Pat. No. 34,664 and DUST-COLLECTING SYSTEM FOR CIRCULAR KNITTING MACHINE of U.S. Pat. No. 4,312,195 commonly use a suction channel connected to a suction source for sucking up dust and fluff from the annular loop-forming zone. The other way is to use a dust blower means to blow dust and fluff away from the annular loop-forming zone of the circular knitting machine, for example, by installing a plurality of blower fans mounted on the center of the circular knitting machine and controlled by a constant speed motor to blow radially dust and fluff away from the annular loop-forming zone of the circular knitting machine. U.S. Pat. No. 4,505,136, issued to the present inventor, discloses a dust blower for circular knitting machines, having a plurality of electric fans, with each being mounted on an arm adjustably mounted around a rotatable frame which is driven by a driving device independent of the electric fans, with the driving device being an electric motor or a rotating member of the circular knitting machine with which the dust blower is used.

The aforesaid dust collecting and blowing systems are still not satisfactory in function because they cannot prohibit dust and fluff from entering the motor. If fluff enters the motor during the operation of the motor, it will be burned, causing the motor to be damaged.

SUMMARY OF THE INVENTION

According to one aspect of the present invention, the dust blower is mounted at the center of a circular knitting machine and controlled to blow dust and fluff away from the annular loop-forming zone of the circular knitting machine. The blower comprises a constant speed motor, a rigid guide tube connected to a compressed air source and rotate horizontally by the constant speed motor, and a swivel nozzle head mounted on one end of the rigid guide tube and rotated vertically when compressed air is driven out of the radial nozzles thereof.

According to another aspect of the present invention, when compressed air is driven out of the swivel nozzle head, the swivel nozzle head is rotated vertically on its own axis, and therefore axial flows of compressed air are driven out of the radial nozzles and around swivel nozzle head to simultaneously blow dust and fluff away from the constant speed motor during the operation of the constant speed motor.

DETAILED DESCRIPTION OF THE PREFERRED EMBODIMENT

Figure 1:
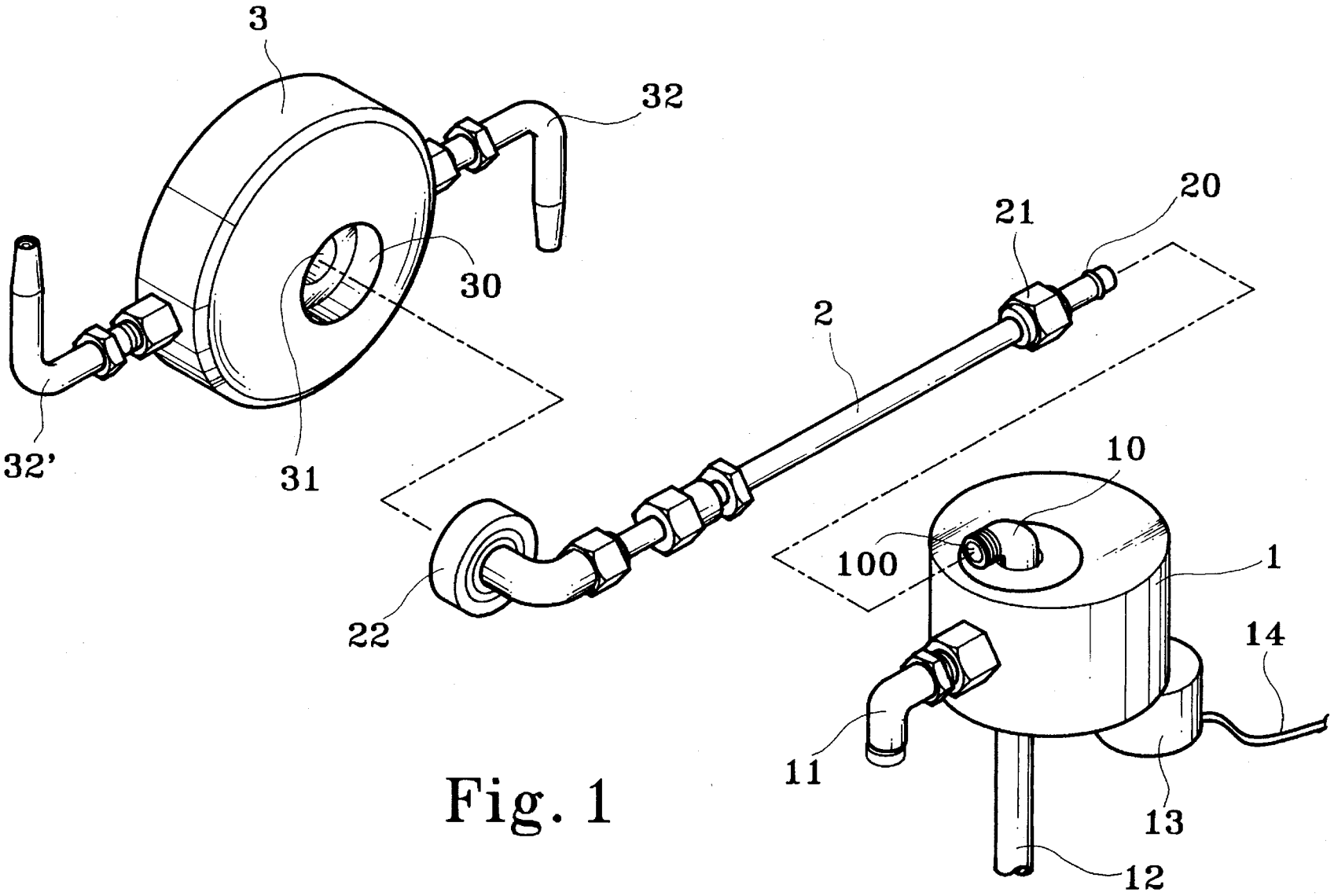
FIG. 1 is an exploded view of a dust blower according to the present invention.

Referring to FIG. 1, a dust blower for a circular knitting machine in accordance with the preferred embodiment of the present invention is generally comprised of a constant speed motor 1, a rigid guide tube 2, and a swivel nozzle head 3. The constant speed motor 1 comprises an air intake pipe 11 extending from the periphery of motor 1, a bent air outlet tube 10 eccentrically disposed at the top side and rotated by the rotor (not shown) of the motor to guide air from the air intake pipe 11 out of an air outlet 100 of tube 10, a stem 12 disposed at the bottom side and mounted on the center of the circular knitting machine, a transformer 13 and its electric wire 14, The rigid guide tube 2 has one end connected to the air outlet 100 of tube 10 by a lock nut 21 and sealed by a rubber ring 20, and an opposite end bent at a right angle and coupled with a ball bearing assembly 22. The outer race of the ball bearing assembly 22 is mounted within the center hole 30 of the swivel nozzle head 3. The swivel nozzle head 3 comprises an air intake port 31 communicated with the center hole 30 thereof, and a plurality of radially extending and oppositely directed nozzles 32 and 32' communicating with the air intake port 31. Through the nozzles 32 and 32' compressed air is driven out of the swivel nozzle head 3 along different tangential lines. When compressed air is driven into the nozzles 32 and 32' through the air intake port 31, the swivel nozzle head 3 is forced to rotate on the ball bearing assembly 22 of the rigid guide tube 2, and a curtain of air is formed around the swivel nozzle head 3 to blow dust and fluff away from the area around the swivel nozzle head 3.

Figure 2:
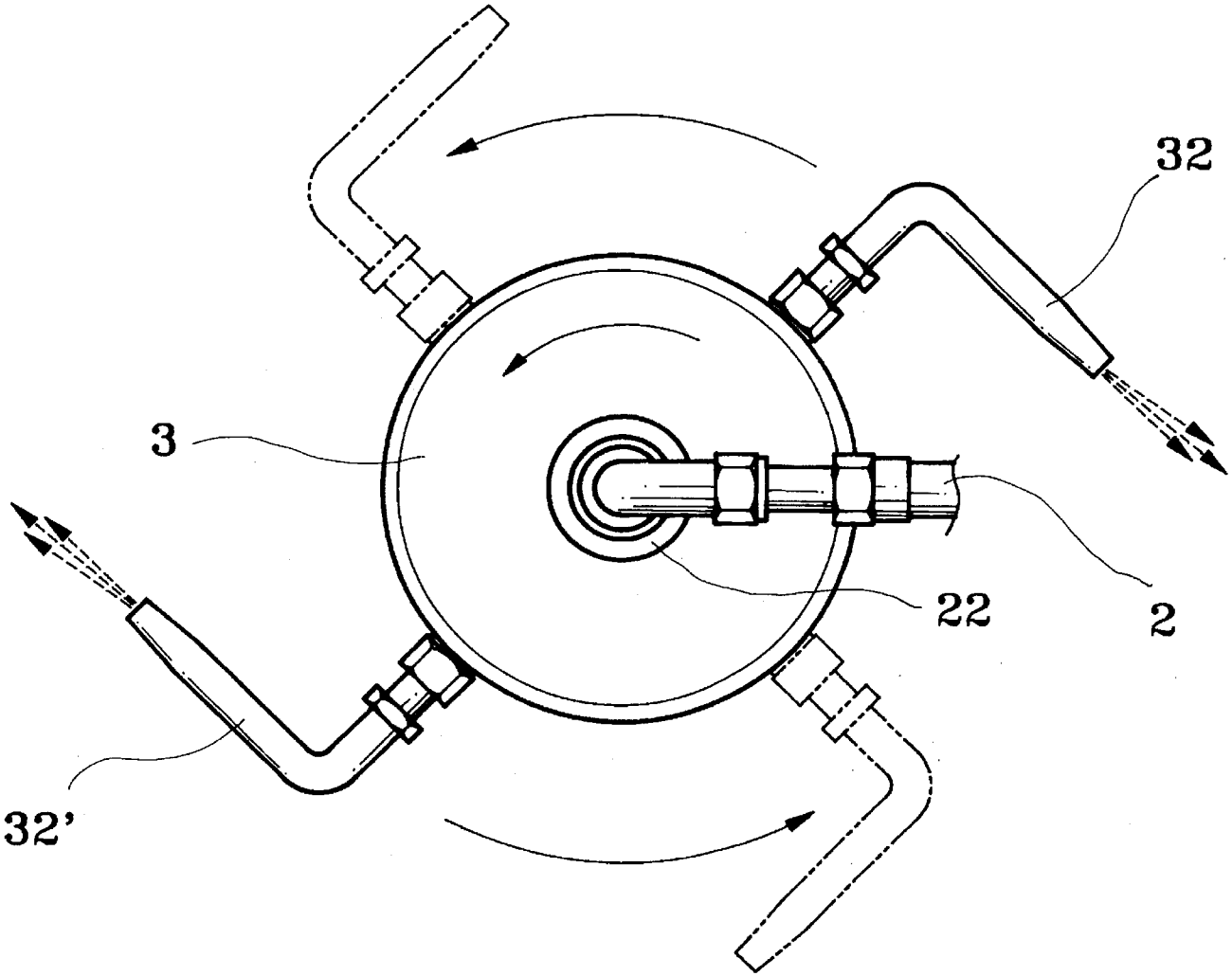
FIG. 2 shows the swivel nozzle head rotating on the ball bearing according to the present invention.

Referring to FIG. 2, when compressed air is driven out of the nozzles 32 and 32', the force of reverse reaction forces the swivel nozzle head 3 to about its axis on the ball bearing assembly 22 across a vertical plane perpendicular to the rotary motion of the rigid guide tube 2 about its axis across a horizontal plane.

Figure 3:
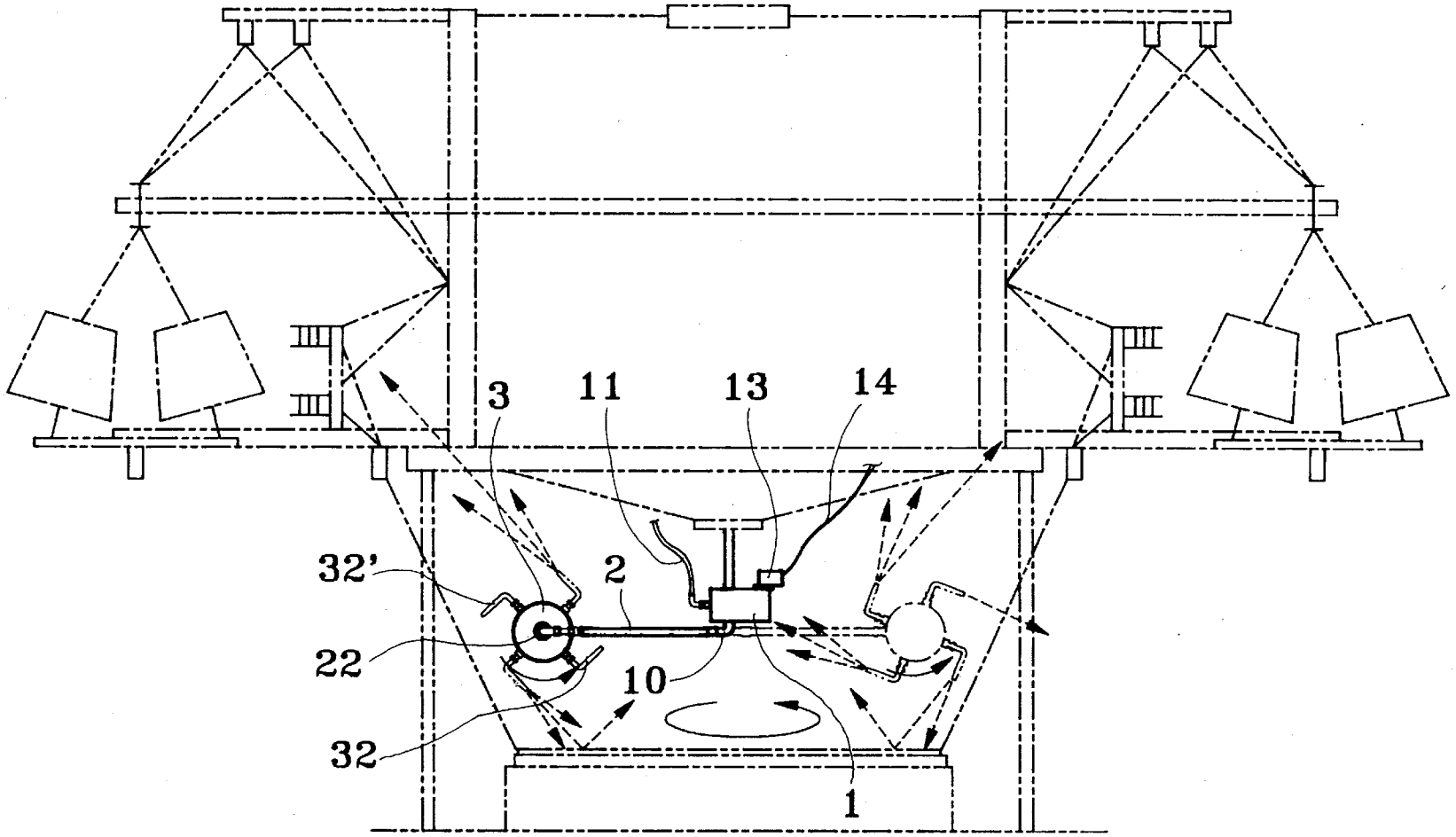
FIG. 3 shows the dust blower of the present invention installed for operation in a circular knitting machine.

Referring to FIG. 3, when the constant speed motor 1 is operated, the rigid guide tube 2 is rotated across the horizontal plane by the bent tube 10 rotating about the longitudinal central axis of the circular knitting machine, and the swivel nozzle head 3 is simultaneously rotated across the vertical plane about own axis, and therefore currents of compressed air are driven out of the swivel nozzle head 3 in all directions to effectively blow dust and fluff out of the annular loop-forming zone of the circular knitting machine.

It is to be understood that the embodiment of the invention disclose herein is for purposes of illustration only, and is not intended to limit the invention, the scope of which is defined by the subjoined claims.

I claim:

1. A dust blower for central mounting on a circular knitting machine to blow dust and fluff away from an annular loop-forming zone of the knitting machine, the dust blower comprising:

a) an electric motor, a compressed air inlet and a compressed air outlet, the compressed air outlet being mounted for rotation by the motor;

b) a guide tube including a first end and a second end, the first end being mounted to the compressed air outlet for rotation thereby across a first plane and receiving compressed air therefrom; and c) a nozzle head for receiving compressed air from the guide tube, means for rotatably mounting the nozzle head to the second end of the guide tube, the nozzle head including a plurality of radially extending and oppositely directed nozzles for ejecting compressed air and rotating the nozzle head across a second plane, and the second plane being perpendicular to the first plane.

2. The dust blower of claim 1 wherein the means for rotatably mounting the nozzle head to the second end of the guide tube includes a ball bearing assembly.

* * * * *